US009168625B2

(12) United States Patent
Huang et al.

(10) Patent No.: US 9,168,625 B2
(45) Date of Patent: Oct. 27, 2015

(54) COMPUTER NUMERICAL CONTROL MACHINE TOOL FOR GRINDING TWO SIDES OF A PLANE BY SHIFTING SELF-ROTATION AND ULTRASONIC VIBRATION

(75) Inventors: Yumei Huang, Xi'an Shaanxi (CN); Wen Yan, Xi'an Shaanxi (CN); Feng Gao, Xi'an Shaanxi (CN); Hao Jiang, Xi'an Shaanxi (CN)

(73) Assignee: XI'AN UNIVERSITY OF TECHNOLOGY, Xi'an Shaanxi (CN)

( * ) Notice: Subject to any disclaimer, the term of this patent is extended or adjusted under 35 U.S.C. 154(b) by 326 days.

(21) Appl. No.: 13/820,975

(22) PCT Filed: Sep. 8, 2011

(86) PCT No.: PCT/CN2011/079475

§ 371 (c)(1),
(2), (4) Date: Mar. 5, 2013

(87) PCT Pub. No.: WO2012/034497

PCT Pub. Date: Mar. 22, 2012

(65) Prior Publication Data

US 2013/0165019 A1 Jun. 27, 2013

(30) Foreign Application Priority Data

Sep. 14, 2010 (CN) ..... 2010 1 0280964

(51) Int. Cl.
*B24B 1/04* (2006.01)
*B24B 37/08* (2012.01)
(Continued)

(52) U.S. Cl.
CPC ... *B24B 1/04* (2013.01); *B24B 7/17* (2013.01); *B24B 37/08* (2013.01); *B24B 41/067* (2013.01)

(58) Field of Classification Search
CPC ..... B24B 1/04; B24B 7/17; B24B 35/00; B24B 37/005; B24B 37/04; B24B 37/08; B24B 49/00; B24B 41/067
See application file for complete search history.

(56) References Cited

U.S. PATENT DOCUMENTS 3,093,937 A * 6/1963 Balamuth et al. ..... 451/165
4,205,489 A * 6/1980 Orlov et al. ..... 451/269
(Continued)

FOREIGN PATENT DOCUMENTS

CN 2894938 Y 5/2007
CN 100361782 C 1/2008
(Continued)

*Primary Examiner* — Timothy V Eley
(74) *Attorney, Agent, or Firm* — Dickstein Shapiro LLP

(57) ABSTRACT

A computer numerical control machine tool for grinding two sides of a plane by shifting self-rotation ultrasonic vibration, wherein a pillar (3) is provided on the tool body (1) of the machine tool, a Y axis movement assembly (12) is provided on the platform of the tool body (1), with a lower revolving movement assembly (11), which revolves about a Z coordinate axis, being mounted on the upper surface of the Y axis movement assembly (12), and a lower grinding plate (10) being mounted coaxially above the lower revolving movement assembly (11); an ultrasonic vibration assembly (2) is mounted fixedly on the pillar (3), with a separation plate (8) for clamping a workpiece assembly (9) being provided on the ultrasonic vibration assembly (2); an X axis movement assembly (4) is mounted on the upper part of the pillar (3), a Z axis movement assembly (5) is mounted on the upright face of the X axis movement assembly (4), with an upper revolving movement assembly (6), which revolves about the Z coordinate axis, being provided on the Z axis movement assembly (5), and an upper grinding plate (7) being mounted coaxially on the revolving axis of the upper revolving movement assembly (6). The present invention enhances the time variation of grinding movement tracks, the uniformity of grinding speed distribution, machining efficiency and machining precision.

4 Claims, 2 Drawing Sheets

(51) Int. Cl.
*B24B 7/17* (2006.01)
*B24B 41/06* (2012.01)

(56) References Cited

U.S. PATENT DOCUMENTS

| | | | | |
|---|---|---|---|---|
| 6,210,259 | B1 * | 4/2001 | Malkin et al. | 451/166 |
| 7,125,313 | B2 * | 10/2006 | Zelenski et al. | 451/5 |
| 7,507,143 | B2 * | 3/2009 | Yamada | 451/5 |
| 8,221,190 | B2 * | 7/2012 | Tokura et al. | 451/5 |
| 2009/0104858 | A1 * | 4/2009 | Yamamoto | 451/259 |
| 2013/0111981 | A1 * | 5/2013 | Huang et al. | 73/78 |
| 2013/0115857 | A1 * | 5/2013 | Huang et al. | 451/8 |

FOREIGN PATENT DOCUMENTS

| | | | |
|---|---|---|---|
| CN | 201015839 | Y | 2/2008 |
| CN | 101947749 | A | 1/2011 |
| JP | 11-320392 | A | 11/1999 |
| JP | 2000-33560 | A | 2/2000 |
| JP | 2009-34812 | A | 2/2009 |

* cited by examiner

COMPUTER NUMERICAL CONTROL MACHINE TOOL FOR GRINDING TWO SIDES OF A PLANE BY SHIFTING SELF-ROTATION AND ULTRASONIC VIBRATION

TECHNICAL FIELD

The present invention belongs to a technical field of mechanical processing equipments, relates to a computer numerical control machine tool for grinding tow sides of a plane, and more particularly to a computer numerical control machine tool for grinding two sides of a plane by shifting self-rotation and ultrasonic vibration.

BACKGROUND ART

Grinding is a final finishing method of precision machining or super precision machining. The grinding methods can be classified into a loose abrasive grinding, a fixed abrasive grinding, a magnetic grinding, a vibration grinding, an electrolytic grinding, a mechanical-chemistry grinding, a magnetic fluid grinding and the like. The grinding methods can also be classified into a plane grinding and a curved surface grinding according to a surface shape of a workpiece. The plane grinding is further divided into one side grinding and two sides grinding. With respect to the two sides grinding, the workpiece is placed between an upper grinding plate and a lower grinding plate with two sides of the workpiece being grinded at the same time, resulting in a high grinding efficiency. The present invention relates to a computer numerical control machine tool for grinding two sides of a plane by fixed abrasives (that is, the abrasive and the grinding tool are combined as a grinding plate).

Requirements for the grinding principle include: 1) the grinding movement track should continuously change at each instant (that is, the grinding movement track should be time-variant), and should not repeat as possible, so as to ensure forming uniform grinding stripes on the surface of the workpiece without any leading direction; 2) the relative movement speed between the grinding plate and the workpiece should be distributed as uniform as possible, because the speed is very important for the uniform grinding of the grinding plate, the uniform grinding of the workpiece and the surface shape precision of the grinding plate and the workpiece; 3) a high grinding speed should be adopted in order to improve a machining efficiency, whereas the surface residual stress will increase as the grinding speed increases, so does the hardening extent of the surface, and thus, the surface residual stress and the hardening limit the increase of the grinding speed.

With respect to the fixed abrasive plane grinding, it requires that the workpiece should be self-rotatable while the grinding plate is rotating so as to guarantee the tracks of the grinding movement (the relative movement between the grinding plate and the workpiece) unrepeated to satisfy the time-variation requirement of the grinding movement. The existing double surface grinding machines mostly adopt a planetary mechanism to drive a separation plate to perform a planetary motion, so as to bring the workpiece to self-rotate. However, the structure of the planetary mechanism is relatively complex and the stress conditions of the separation plate (planet gear) is rather bad, resulting in a heavy wear. The distance (radius) between the self-rotation center of the workpiece and the center of the grinding plate is constant, so that the rotation may be referred to as a constant distance self-rotation. One of the defects of the constant distance self-rotation lies in that the self-rotation speed of the workpiece at its self-rotation center is zero, which degrades the time-variation property. Another defect lies in that the grinding speed at each grinding point on the surface of the workpiece equals to the sum of the rotation speed of the grinding plate and the linear velocity of the self-rotation speed of the workpiece at the grinding point, and the distribution uniformity of the grinding speed is deteriorated, because the speed at the self-rotation center of the workpiece is zero. A certain double surface plane grinding machine operates in a manner that the separation plate performs an eccentric transitional motion, the upper grinding plate and the lower grinding plate are fixed, and the workpiece is clamped in the separation plate to perform a transitional motion along therewith (brought by a sine mechanism). This kind of double surface grinding machines can partially overcome the defects of the bad track time-variation and bad uniformity of grinding speed distribution in the former grinding method, while there are still defects as follows: the sine mechanism is complex in structure, the stress condition of the separation plate is bad and the abrasion is serious, especially, the upper and lower grinding plates are fixed and only the workpiece performs a planar motion, so that the grinding speed is low, and thus the processing efficiency is low. The grinding contact pressure of a general grinding machine tool for grinding two sides of a plane is controlled by a hydraulic device. At present, there is no computer numerical control machine tools for grinding two sides of a plane by shifting self-rotation in which not only the workpiece can self-rotate along therewith (i.e. self-rotate without being driven by the partition plate), but also a self-rotation position of the workpiece can be automatically controlled through a numerical control.

The ultrasonic vibration grinding includes a loose abrasive ultrasonic vibration grinding and a fixed abrasive ultrasonic vibration grinding. With respect to the fixed abrasive ultrasonic vibration grinding, an ultrasonic vibration apparatus is used to drive the fixed abrasives to generate a high frequency vibration. The fixed abrasive ultrasonic vibration grinding differs from the normal grinding in that: during the general grinding, if the abrasives move once relative to the workpiece, then the abrasive cutting edge of the normal grinding tool only performs cutting operation once. However, during an ultrasonic vibration grinding, each of the abrasive cutting edges in the fixed abrasives grinding tool vibrates at a frequency of twenty thousands to fifty thousands times per second and conducts a fine cutting (grinding), accordingly the processing efficiency is high, and uniform, fine and dense cutting tracks are generated on the workpiece with a low surface roughness and a high machining precision. The fixed abrasive ultrasonic vibration grinding is adapted to a small mass fixed abrasive application (such as an outer circumference grinding), but hardly implemented on the double side grinding plate for grinding two sides of a plane. Till now, there is no computer numerical control machine for grinding two sides of a plane in which the upper and lower grinding plates are driven by an ultrasonic vibration apparatus to vibrate at a high frequency.

DISCLOSURE OF INVENTION

Technical Problems

The present invention aims to provide a computer numerical control machine tool for grinding two sides of a plane by shifting self-rotation and ultrasonic vibration, so as to comprehensively improve the time variation of grinding movement tracks and the uniformity of grinding speed distribution; and the ultrasonic vibration apparatus is adopted to drive the separation plate to generate a high frequency vibration so as to improve the processing efficiency and the machining precision.

Technical Solution

According to the technical solution adopted by the present invention is a computer numerical control machine tool for grinding two sides of a plane by shifting self-rotation and ultrasonic vibration which includes: a pillar is provided on a tool body of the machine tool, a Y axis movement assembly is provided on a platform of the tool body, with a lower revolving movement assembly, which revolves about a coordinate axis Z, being mounted on an upper surface of the Y axis movement assembly, and a lower grinding plate being mounted coaxially above the lower revolving movement assembly; an ultrasonic vibration assembly is fixedly mounted on the pillar, with a separation plate for clamping a workpiece assembly being provided on the ultrasonic vibration assembly; an X axis movement assembly is mounted on the pillar, and a Z axis movement assembly is mounted on an upright face of the X axis movement assembly, with an upper revolving movement assembly, which revolves about the coordinate axis Z, being provided on the Z axis movement assembly, and an upper grinding plate being mounted coaxially on the revolving axis of the upper revolving movement assembly.

The computer numerical control machine tool for grinding two sides of a plane by shifting self-rotation and ultrasonic vibration characterizes in that each of the X axis movement assembly, the Z axis movement assembly and the Y axis movement assembly is provided with a numerical control servo axis, the Z axis movement assembly is controlled by a moment control mode, position precision of the Z axis movement assembly is controlled by a displacement sensor control mode, both the X axis movement assembly and the Y axis movement assembly are controlled by a position control mode; and the revolving movements of the upper revolving movement assembly and the lower revolving movement assembly revolving around the coordinate axis Z are controlled by using a variable frequency motor driving mode.

The ultrasonic vibration assembly is configured to include: the rear connecting member is fixedly mounted to the pillar, an elastic member is disposed between the rear connecting member and a front connecting member, the rear connecting member, the front connecting member and elastic member are connected through screws; guiding pins are additionally provided between the rear connecting member and the front connecting member, one end of the guiding pin is fixedly connected to the rear connecting member and the other end thereof matches with a pin hole in the front connecting member; an ultrasonic transducer is provided in an inner chamber of the rear connecting member, the ultrasonic transducer is fixedly connected with the amplitude-variable bar and the front connecting member in sequence; and the front connecting member is fixedly connected with the separation plate.

A front end of the separation plate is provided with a circular inner hole, the axis of which is parallel to the coordinate axis Z; the workpiece assembly is received in the inner hole of the separation plate with both of the upper surface and the lower surface of a workpiece of the workpiece being exposed outside of the separation plate; the workpiece assembly comprises the workpiece and a clamper, the workpiece is clamped in the inner hole of the clamper, the upper and lower surfaces of the workpiece are exposed outside of the damper; the damper has an outline of circular plate shape, and matches with the circular inner hole of the separation plate (8), and the inner hole of the clamper matches an outline of the workpiece.

A plurality of inner holes are provided in the separation plate, and each of a plurality of workpieces is received in each of the inner holes.

Advantageous Effect

The beneficial effects of the computer numerical control machine tool of the present invention lie in that: the workpiece assembly passively self-rotate around its center, through a moment generated by a resultant force of the grinding forces applied to the workpiece by the upper grinding plate and the lower grinding plate, and thus the separation plate only vibrates at a high frequency while the stress condition is good; the self-rotation of the workpiece assembly is a shifting self-rotation; the time variance of the grinding movement tracks is good due to the self-rotation and automatically controlled shifting; the ultrasonic vibration is applied to the separation plate, which adds a high frequency vibration to the workpiece assembly, thus the grinding speed is greatly uniformed, the distribution uniformity of the grinding speed, the machining efficiency and the machining precision can be improved, and the surface residual stress and the hardening can be reduced during a high speed grinding; and the grinding contact pressure is controlled and achieved by a moment control of the numerical control servo axis, and thus the structure is simplified.

Figure 1:
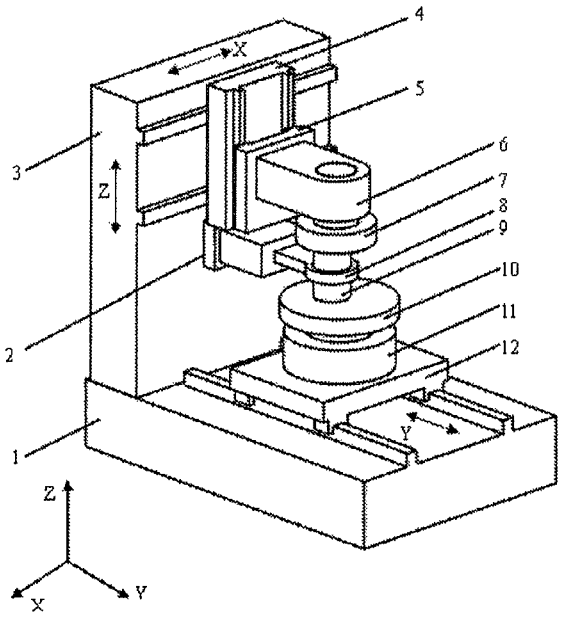
FIG. 1 is a schematic view for illustrating the configuration of the computer numerical control machine tool according to the present invention.

In the drawings, 1: tool body, 2: ultrasonic vibration assembly, 3: pillar, 4: X axis movement assembly, 5: Z axis movement assembly, 6: upper revolving movement assembly, 7: upper grinding plate, 8: separation plate, 9: workpiece assembly, 10: lower grinding plate, 11: lower revolving movement assembly, 12: Y axis movement assembly, 2-1: back connection member, 2-2: elastic element, 2-3: front connection member, 2-4: amplitude-variable bar, 2-5: guide pin, 2-6: ultrasonic transducer.

DETAILED DESCRIPTION OF THE PREFERRED EMBODIMENT

Reference will now be made in detail to the present invention in combination with drawings and the detailed embodiments.

FIG. 1 shows the structure of the computer numerical control machine tool of the present invention. As shown in FIG. 1, a pillar 3 is disposed at the back portion of the tool body 1, and a Y axis movement assembly 12 is disposed on the platform of the tool body 1, a lower revolving movement assembly 11 which revolves around coordinate axis Z, is mounted on the upper surface of the Y axis movement assembly 12, a lower grinding plate 10 is coaxially mounted on the lower revolving movement assembly 11; an ultrasonic vibration assembly 2 is fixedly mounted on the pillar 3 (on the middle section thereof), and provided with a separation plate 8 for clamping a workpiece assembly 9; an X axis movement assembly 4 which moves horizontally is mounted on the the pillar 3 (on the upper section thereof), a Z axis movement assembly 5 is mounted on an upright face of the X axis movement assembly 4, an upper revolving movement assembly 6 which revolves around the Z axis is mounted on the Z axis movement assembly 5, and an upper grinding plate 7 is coaxially mounted on an revolving shaft of the upper rotation assembly 6.

When implementing the present invention, the pillar 3 is fixed above the rear end of the machine body 1, the rear end of the ultrasonic vibration assembly 2 is fixed on the front lower portion of the pillar 3, the X axis movement assembly 4, Z the axis movement assembly 5 and the upper revolving movement assembly 6 in sequence are mounted in front of and on the upper portion of the pillar 3, the upper grinding plate 7 is coaxially mounted below the upper revolving movement assembly 6 and driven by the upper revolving movement assembly 6 so as to revolve around the Z axis; the Y axis movement assembly 12 and the lower revolving movement assembly 11 are sequentially mounted on the tool body 1 upwardly, and the lower grinding plate 10 is coaxially mounted above the lower revolving movement assembly 11 and is driven by the lower revolving movement assembly 11 so as to revolve around the Z axis.

Each of the X axis movement assembly 4, the Z axis movement assembly 5 and the Y axis movement assembly 12 is provided with a numerical control servo axis, the Z axis movement assembly 5 is further provided with a moment control apparatus to adopt a moment control mode for controlling a grinding contact pressure (referring to the normal contact pressures between the upper and lower surfaces of the workpiece and the upper and lower grinding plates), a position precision of the Z axis movement assembly 5 is controlled by using a displacement sensor control mode of the Z movement axis; both of the X axis movement assembly 4 and the Y axis assembly 12 are controlled by a position control mode; the revolving movements of the upper revolving movement assembly 6 and the lower rotation assembly 11 around the Z axis are controlled by using a variable frequency motor driving mode. All of the above movement assemblies are connected to a central controller and controlled uniformly under the central controller so as to implementing the grinding processing cooperatively.

Figure 2:
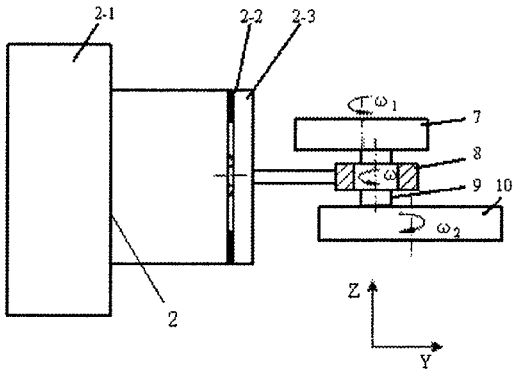
FIG. 2 is a partial schematic view for illustrating the connection between the ultrasonic vibration assembly and the separation plate in the computer numerical control machine tool according to the present invention.

As shown in FIG. 2, the separation plate 8 is disposed between the upper grinding plate 7 and lower grinding plate 10, the rear end of the separation plate 8 is connect to the ultrasonic vibration assembly 2 which apply a high frequency ultrasonic vibration to the separation plate 8, the front end of the separation plate 8 is provided with a circular inner hole, the axis of which is parallel to the Z axis, the workpiece assembly 9 is disposed in the circular inner hole of the separation plate 8, and can perform a self-rotation revolving movement relative to the separation plate 8 around the Z axis, both of the upper surface and the lower surface of a workpiece in the workpiece assembly 9 are exposed outside of the separation plate 8, the lower surface of the upper grinding plate 7 closely presses against the upper surface of the workpiece assembly 9 while the upper surface of the lower grinding plate 10 closely presses against the lower surface of the workpiece assembly 9 such that the grinding contact pressure is applied to the workpiece, and then a grinding cutting force is applied to the workpiece through rotations of the upper and lower grinding plates. When a small workpiece is grinded, a plurality of circular holes may be provided in the separation plate 8, and a plurality of workpieces assembly 9 are inserted into the holes and grinded simultaneously.

Figure 3:
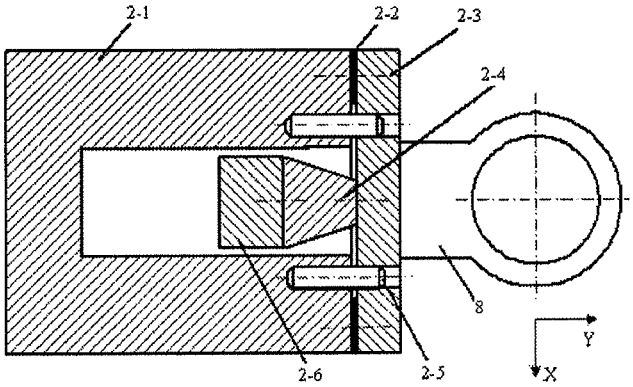
FIG. 3 is a schematic view for illustrating the configuration of the ultrasonic vibration assembly in the computer numerical control machine tool according to the present invention.

As shown in FIG. 3, the ultrasonic vibration assembly 2 is configured to include a rear connecting member 2-1, an elastic member 2-2, a front connecting member 2-3, an amplitude-variable bar 2-4, a guiding pins 2-5, and an ultrasonic transducer 2-6, the rear connecting member 2-1 is fixedly mounted to the pillar 3, the elastic member 2-3 is disposed between the rear connecting member 2-1 and the front connecting member 2-3, the rear connecting member 2-1, the front connecting member 2-3 and elastic member 2-3 are connected through bolts, two groups of guiding pins 2-5 are provided between the rear connecting member 2-1 and the front connecting member 2-3, one end of the guiding pin 2-5 is fixedly connected to the rear connecting member 2-1 while the other end of the guiding pin 2-5 is cooperatively connected with a pin hole in the front connecting member 2-3 so as to provide guiding when the front connecting member 2-3 vibrates relative to the rear connecting member 2-1 at a high frequency; the ultrasonic transducer 2-6 is provided in an inner chamber of the rear connecting member 2-1, the ultrasonic transducer 2-6 is fixedly connected with the amplitude-variable bar 2-4 and the front connecting member 2-3 in sequence, the amplitude-variable bar 2-4 is used for amplifying the vibration amplitude of the ultrasonic transducer 2-6 and then driving the front connecting member 2-3 to vibrate at a high frequency, and the front connecting member 2-3 is fixedly connected with the separation plate 8 so as to drive the separation plate 8 to vibrate at a high frequency so as to drive the workpiece to vibrate at a high frequency, instead of driving the upper grinding plate and lower grinding plate that are fixed abrasives.

Figure 4:
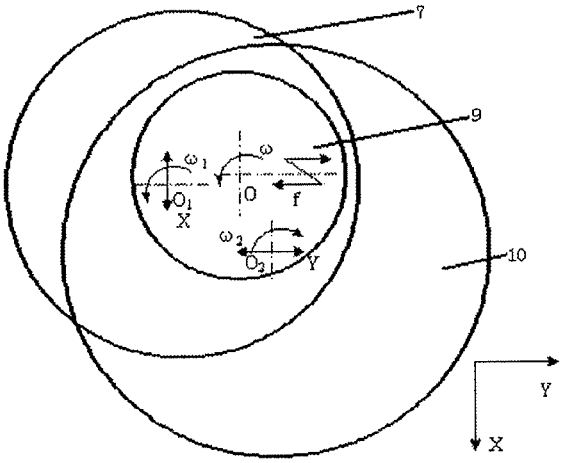
FIG. 4 is a schematic view for illustrating the operation principle of the grinding plates and the workpiece assembly in the computer numerical control machine tool according to the present invention.

As shown in FIG. 4, the upper grinding plate 7 can perform a revolving movement ω1 and a linear movement X, the lower grinding plate 10 can perform a revolving movement ω2 and a linear movement Y, and the workpiece assembly 9 (which brings the workpiece to move) can perform a self-rotation revolving movement ω and a high frequency linear vibration f.

The principle of the apparatus of the present invention lies in that: all of the X, Y and Z movement axes are numerical control servo axes, the Z axis is controlled by the moment control mode so as to control the grinding contact pressure (referring to the normal contact pressures between the upper grinding plate and the upper surface of the workpiece and between the lower grinding plate and lower surface of the workpiece), the position precision of the Z movement axis is controlled by the displacement sensor control mode of the Z movement axis, both the X movement axis and the Y movement axis are controlled by the position-control mode, the revolving movements that the upper revolving movement assembly 6 and the lower rotation assembly 11 revolving around the coordinate axis Z are controlled by using a variable frequency motor driving mode, the high frequency electric oscillation is converted into a high frequency mechanical vibration through the ultrasonic transducer and then amplified by the amplitude-variable bar to drive the separation plate to vibrate at a high frequency, and the workpiece assembly (which includes the workpiece and the clamper, wherein the workpiece is clamped in the inner hole of the clamper and integrated with the clamper with the upper and lower surfaces of the workpiece being exposed outside of the clamper, the clamper is shaped as a circular disc and matches with the circular inner hole of the separation plate, and the inner hole of the clamper matches with an outline of the workpiece, if the workpiece has a square outline, then the inner hole of the clamper will be a square hole) not only can self-rotate relative to the separation plate, but also can vibrate at a high frequency along with the separation plate. The revolving centers of the upper revolving movement assembly and the lower revolving movement assembly are indicated by o1 and o2, respectively, the revolving speeds of the upper revolving movement assembly and the lower revolving movement assembly are indicated by ω1 and ω2, respectively, the self-rotation center and the self-rotation speed of the workpiece assembly are indicated by o and ω, respectively, the distance between o1 and o is indicated by R1, the distance between o2 and o is indicated by R2, there is no macroscopic movement at the rotation center of the workpiece assembly, and there is merely a minute high vibration displacement with the frequency f additionally added by the ultrasonic vibration assembly, thereby the distances R1 and R2 will change along with the movements of the X axis and the Y axis.

When the apparatus of the present invention is implementing its operations, on the one hand, the workpiece self-rotates at a speed ω while the position of the self-rotation center o is changing relative to the grinding centers o1 and o2 of the grinding plates; and the workpiece vibrates at a high frequency f relative to the upper grinding plate and the lower grinding plate. The change in the self-rotation speed of the workpiece and the relative positional change of the self-rotation center position relative to the centers of the upper grinding plate and the lower grinding plate are comprehensively influenced and determined by the revolving movements of the upper and lower grinding plates, the X axis movement, the Y axis movement and the additional vibration of the ultrasonic vibration assembly. The self-rotation of the workpiece belongs to a passive self-rotation along with its movement, that is, the workpiece assembly self-rotates around its center through the moment generated by the resultant of the grinding cutting forces applied to the workpiece by the upper grinding plate and the lower grinding plate (referring to the cutting forces applied to the workpiece by the abrasive particles on the fixed grinding plate), instead of being brought by the rotation of the separation plate, thus, the separation plate only vibrates at a high frequency and the stress condition is well; the positional change in the self-rotation center relative to the positions of the centers o1 and o2 of the upper grinding plate and the lower grinding plate is automatically controlled by the movements of the X and Y servo axes, whereby the time variance of the grinding movement is good due to the passive self-rotation and automatic control shifting position, and the workpiece vibrates at a high frequency f, which is bought by the vibration of the ultrasonic vibration assembly through the separation plate, instead of the high frequency vibrations of the upper and lower grinding plates serving as grinding tools.

The invention claimed is:

1. A computer numerical control machine tool for grinding two sides of a plane by shifting self-rotation and ultrasonic vibration, being characterized in that a pillar (3) is provided on a tool body (1) of the machine tool, a Y axis movement assembly (12) is provided on a platform of the tool body (1), with a lower revolving movement assembly (11), which revolves about a coordinate axis Z, being mounted on an upper surface of the Y axis movement assembly (12), and a lower grinding plate (10) is mounted coaxially above the lower revolving movement assembly (11); an ultrasonic vibration assembly (2) is fixedly mounted on the pillar (3), with a separation plate (8) for clamping a workpiece assembly (9) being provided on the ultrasonic vibration assembly (2); an X axis movement assembly (4) is mounted on the pillar (3), and a Z axis movement assembly (5) is mounted on an upright face of the X axis movement assembly (4), with an upper revolving movement assembly (6), which revolves about the coordinate axis Z, being provided on the Z axis movement assembly (5), and an upper grinding plate (7) being mounted coaxially on the revolving axis of the upper revolving movement assembly (6).

2. The computer numerical control machine tool for grinding two sides of a plane by shifting self-rotation and ultrasonic vibration according to claim 1, being characterized in that each of the X axis movement assembly (4), the Z axis movement assembly (5) and the Y axis movement assembly (12) is provided with a numerical control servo axis, the Z axis movement assembly (5) is controlled by a moment control mode, position precision of the Z axis movement assembly (5) is controlled by a displacement sensor control mode, both of the X axis movement assembly (4) and the Y axis movement assembly (12) are controlled by a position control mode; and revolving movements of the upper revolving movement assembly (6) and the lower revolving movement assembly (11) revolving around the Z coordinate axis are controlled by using a variable frequency motor driving mode.

3. The computer numerical control machine tool for grinding two sides of a plane by shifting self-rotation and ultrasonic vibration according to claim 1, being characterized in that the ultrasonic vibration assembly (2) is configured such that a rear connecting member (2-1) is fixedly mounted to the pillar (3), an elastic member (2-3) is disposed between the rear connecting member (2-1) and a front connecting member (2-3), the rear connecting member (2-1), the front connecting member (2-3) and elastic member (2-2) are connected through screws; Guiding pins (2-5) are additionally provided between the rear connecting member (2-1) and the front connecting member (2-3),one end of each of the guiding pins (2-5) is fixedly connected to the rear connecting member (2-1) and the other end thereof matches with a pin hole in the front connecting member (2-3); an ultrasonic transducer (2-6) and an amplitude-variable bar (2-4) are provided in an inner chamber of the rear connecting member (2-1), the ultrasonic transducer (2-6) the amplitude-variable bar (2-4) and the front connecting member (2-3) are fixedly connected in sequence; and the front connecting member (2-3) is fixedly connected with the separation plate (8).

4. The computer numerical control machine tool for grinding two sides of a plane by shifting self-rotation and ultrasonic vibration according to claim 1, wherein a front end of the separation plate (8) is provided with a plurality of inner holes, the axis of which is parallel to the coordinate axis Z, each of the inner holes is provided with one workpiece assembly (9) therein, with both of an upper surface and a lower surface of a workpiece of the workpiece assembly (9) being exposed outside of the separation plate (8); the workpiece assembly (9) comprises the workpiece and a clamper, the clamper has an outline of disc shape which matches with the inner hole of the separation plate (8), and the clamper has an inner hole which matches an outline of the workpiece, the workpiece is clamped in the inner hole of the clamper, the upper and lower surfaces of the workpiece are exposed outside of the clamper.

* * * * *